US005277134A

United States Patent [19]

Schlessing et al.

[11] Patent Number: 5,277,134

[45] Date of Patent: Jan. 11, 1994

[54] COAL MILL CONTROL PROCESS

[75] Inventors: Johann Schlessing, Bliesransbach; Gunter Klotz, Mannheim-Neckarau, both of Fed. Rep. of Germany

[73] Assignee: EVT Energie- und Verfahrenstechnik GmbH, Stuttgart, Fed. Rep. of Germany

[21] Appl. No.: 966,733

[22] Filed: Oct. 26, 1992

[30] Foreign Application Priority Data

Oct. 31, 1991 [DE] Fed. Rep. of Germany ..... 4135848

[51] Int. Cl.[5] ..... F23N 5/18

[52] U.S. Cl. ..... 110/188; 110/232; 236/15 BA; 431/90

[58] Field of Search ..... 110/232X, 185, 188, 186; 236/15BA; 364/153; 431/90X

[56] References Cited

U.S. PATENT DOCUMENTS 4,489,664 12/1984 Williams ..... 110/232 X

FOREIGN PATENT DOCUMENTS 0226522 9/1988 Japan ..... 236/15 BA 2139331 11/1984 United Kingdom ..... 110/232

*Primary Examiner*—William E. Wayner

*Attorney, Agent, or Firm*—Chilton, Alix & Van Kirk

[57] ABSTRACT

The temperatures of the primary carrier gas supplied to a coal pulverizer and the fuel stream discharged from the pulverizer are controlled to keep the fuel stream temperature within a predetermined safe and efficient operating range regardless of the rate at which coal is fed to the pulverizer. A carrier gas temperature versus coal feed schedule is established and used for temperature control. If fuel stream temperature departs from the predetermined operating range, the established schedule is automatically corrected.

9 Claims, 1 Drawing Sheet

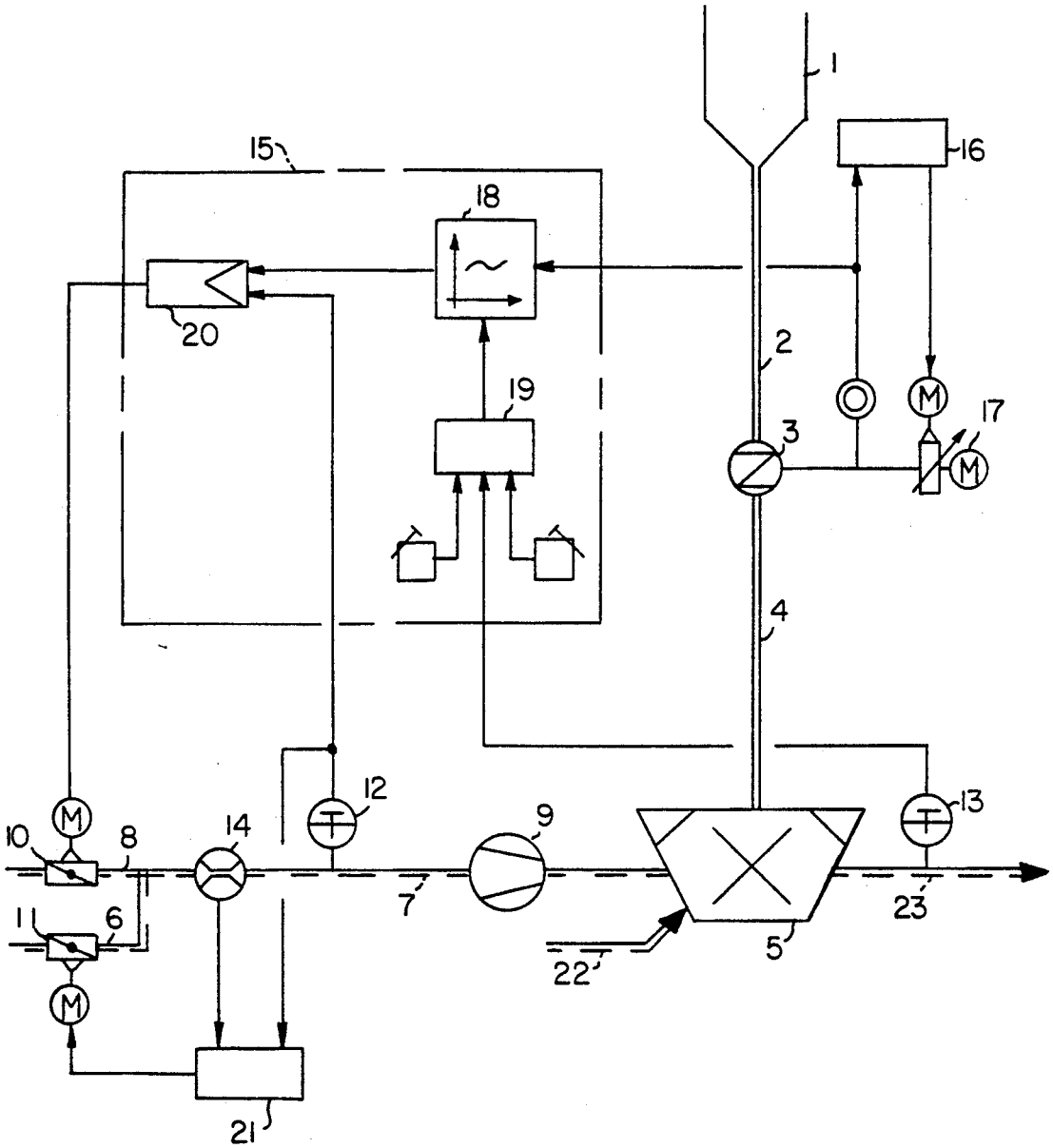
1
15
16
18
20
2
19
17
3
4
12
13
10
8
14
9
7
23
11
6
5
22
21

COAL MILL CONTROL PROCESS

BACKGROUND OF THE INVENTION

1. Field of the Invention

The present invention relates to the operation of a mill and particularly the exercise of control over a roller mill employed in a fuel feed system of a fuel consuming load such as a steam generator. More specifically, the present invention is directed to a temperature control system for a roller mill which produces, from coal and pressurized gas feeds, a fuel stream comprising coal dust entrained in a carrier gas. Accordingly, the general objects of the present invention are to provide novel and improved methods and apparatus of such character.

2. Description of the Prior Art

It is well known in the art to fuel steam generators, vaporizers and other fossile fuel consuming loads by delivering thereto a highly volatile mixture of coal dust entrained by a carrier gas. Such fuel mixtures are produced in roller mills which receive "raw" coal and pressurized air. In the operation of a roller mill, it is known to automatically regulate the amount of coal fed into the mill as a function of the steam generator load. Controls for achieving such coal feed regulation, while at the same time insuring safe mill operation, have typically operated by controlling the volume of carrier gas in accordance with pre-calculated ratios of coal to primary feed air. Safe mill operation requires, in addition to maintaining the appropriate coal/air ratio, that the temperature of the fuel stream exiting the roller mill be maintained within safe limits. This requisite temperature control is accomplished by mixing cold air with the "hot" or primary air delivered to the mill.

A disclosure of a prior art mill having a temperature safety control at the mill outlet is disclosed in the brochure entitled "SUHUSSELMUHLEN/BOWL MILLS" Publication No. 3000-KO 4.88, Page 10.

Prior art mill control apparatus and techniques have not been altogether satisfactory. One particular disadvantage of known roller mill controls, of the type briefly described above, resides in the fact that the air-control valves have a delayed reaction. Restated, employing previous control technology, the mill cannot respond quickly when the rate of change of the steam generator load is high. The conventional method of overcoming this disadvantage is to override the mill control. However, this solution presents the possibility of local overheating in the steam generator or other device to which the pulverized coal/air mixture is being delivered.

It is to be noted that prior art roller mill controls have also contributed to noisy mill operation and have, because of the ability to safely respond to only relatively small load gradients, imposed a limitation upon mill capacity. A further problem related to prior art control techniques has been the discharge of excess coal through pyrite ejection.

SUMMARY OF THE INVENTION

The present invention overcomes the above-briefly discussed and other deficiencies and disadvantages of the prior art by providing a novel and improved process for operating a mill, particularly a roller mill, and a control system for the implementation of this novel process. The present invention is, in effect, an adaptive control technique wherein the temperatures at the mill primary air inlet and fuel stream outlet are measured for different mill loads over the operational range of the coal metering hopper which supplies the coal to be pulverized. These measured temperatures, and the associated loads, are employed to generate an operational "curve" which is "followed" to exercise control over the air temperature at the mill inlet as load, i.e., the amount of raw coal delivered to the mill, varies under normal operating conditions. However, if the fuel stream temperature at the mill outlet departs from a predetermined safe operational range, the operational "curve" is adjusted, i.e., the desired inlet temperature level(s) is reset and the new level is thereafter employed to control the mill inlet air temperature.

BRIEF DESCRIPTION OF THE DRAWING

The present invention may be better understood and its numerous objects and advantages will become apparent to those skilled in the art by reference to the accompanying drawing which is a functional block diagram of a control system in accordance with the invention.

DESCRIPTION OF THE PREFERRED EMBODIMENT

With reference now to the drawing, a system for providing fuel for a steam generator, the steam generator not being shown in the drawing, is depicted schematically. The fuel to be delivered to the steam generator will comprise pulverized coal entrained in an air stream. The coal to be pulverized is delivered from a bunker 1 to a coal metering hopper 3 via a supply conduit 2. The metering hopper 3 is controlled, in the manner to be described below, so as to deliver measured quantities of coal to a roller mill 5 via conduit 4. The air which entrains the coal dust produced by mill 5 is provided by a blower 9. The air supply to blower 9 is derived from a cold air inlet supply conduit 8 and a "hot" air inlet supply conduit 6. The hot air supply conduit 6 is connected to an air preheater, not shown. The air supplied by conduits 6 and 8 is mixed and delivered by a conduit 7 to blower 9.

The air supply lines 6 and 8 are respectively provided with control valves 11 and 10. A primary or feed air temperature sensor 12 is provided in conduit 7 upstream of blower 9. Additionally, an air volume sensor 14 is provided in conduit 7. Accordingly, signals commensurate with the temperature and flow rate of the air being supplied to mill 5 via blower 9 are available. These signals are delivered to a primary air volume control 21 which produces a control signal for the hot air valve 11 which is the primary air flow control. That is, the setting of valve 11, and thus the primary air volume, will be controlled as a predetermined function of primary air temperature, i.e., the control 21 includes a predetermined flow rate versus temperature schedule which is compared with the temperature signal from sensor 12 to generate a control signal for valve 11. The control loop is closed by feeding back the actual flow information as measured by sensor 14, the signals commensurate with actual and commanded flow being compared in the customary manner to insure rapid and accurate valve response.

The fuel mixture of coal dust and primary air exits roller mill 5 via fuel supply conduit 23. A temperature sensor 13 will measure the temperature of the fuel mixture downstream of mill 5. In the manner known in the art, additional "trapped" air is delivered to mill 5 via conduit 22.

The quantity of coal delivered to mill 5 is, as noted, controlled by means of a coal-metering hopper 3. The metering function consists of varying the speed of revolution of a rotatable metering member in hopper 3, the drive for the metering member being derived from a drive motor 17. The exercise of control over the RPM of the metering device in hopper 3 is accomplished through the use of a closed loop control 16 which receives a command input, not shown, which corresponds to the load on the downstream steam generator. The load on the steam generator, of course, is commensurate with the quantity of fuel required by the steam generator.

The present invention encompasses a novel temperature control which has been indicated generally at 15. Temperature control 15, which operates in the manner to be described below, includes means 18 for storing temperature/load information, a reset controller 19, high and low temperature reference signal generators which are connected to controller 19, and a comparator 20. The temperature control 15 receives, as input signals, the mill load signal derived from the feedback loop for control 16 and the temperature signals provided by sensors 12 and 13.

The control of the present invention is initially configured by sensing the mill air inlet and fuel stream outlet temperatures at various levels of loading of the mill 5 when a particular type of coal is employed as the fuel. The sensed temperatures and the RPM of the metering device of hopper 3 are employed to generate a characteristic operating curve which is stored in the means 18, i.e., information storage means 18 will store values of desired primary air temperature which are related to mill load levels. Storage means 18 will provide output signals commensurate with the desired primary air temperature, i.e., the carrier gas temperature upstream of the mill 5, which correspond to the requested mill load. During normal operation, the mill outlet temperature will remain within the proper range if the "desired" primary air temperature as read from storage means 18 is maintained. The desired temperature of the carrier air upstream of mill 5 will be produced, without time delay, as a function of mill load by comparing the desired temperature signal read out of storage means 18 with the actual temperature signal provided by sensor 12. Any difference signal produced by comparator 20 is employed as a primary air temperature control signal which resets the cold air control valve 10.

If the fuel stream temperature as measured by sensor 13 departs from the allowed range, i.e., if the fuel stream temperature either exceeds a preset maximum or falls below a preset minimum, the reset controller 19 will cause the "curve" stored in storage means 18 to be corrected, i.e., the "desired" primary air temperature level for the instaneously existing load will be reset, so that the temperature downstream of mill 5 will return to the permitted temperature range.

As should be obvious from the above discussion, the temperature control 15 compares the desired and actual values of the carrier air temperature upstream of the mill 5 and, by adjusting the volume of cold air delivered to the mixing point in conduit 7, achieves an upstream temperature which will result in the fuel stream temperature downstream of the mill remaining within proper limits. The quantity of primary air is controlled, via control device 21, by setting the amount of hot air delivered into conduit 7 to a level which is commensurate with the actual air temperature upstream of mill 5. As will be obvious to those skilled in the art, the primary air temperature can not be changed as quickly as the primary air flow rate. Restated, the primary air volume control loop reacts to conditions which warrant a change in flow faster than the system will react to commands generated by temperature control 15. Thus, when temperature control 15 commands a resetting of cold air control valve 10, the flow control 21 is able to cause adjustment of the primary air flow volume to the proper level for the actual primary air temperature without any significant deviations.

When a change is made in the mill load, the temperature control 15 will receive a new input signal from the metering hopper control circuit. This new input signal will be commensurate with a desired air temperature upstream of mill 5 which is dependent upon the newly commanded RPM of the metering member in hopper 3. The storage means 18 in the temperature control will then provide a new signal commensurate with the desired temperature of the upstream air and this desired temperature signal will be compared to the actual temperature signal as generated by sensor 12. The results of this comparison will be a control signal, produced by comparator 20, which will cause adjustment of the cold air valve 10. Accordingly, the temperature upstream of mill 5 will be adjusted by varying the ratio of the cold air to the hot air and this upstream temperature adjustment will be accomplished with minimal delay and without there being any overshoot of the proper or permitted temperature range of the fuel stream as measured by sensor 13. However, as noted, should there for any reason be a departure of the fuel stream temperature from the proper range, the "curve" stored in device 18 will be corrected.

The above-described mode of operation results in quieter mill operation and the ability to increase the load capacity of the mill. The present invention also results in less coal being discharged from the mill through pyrite ejection. Most importantly, the present invention, by correcting the information from which the desired air temperature upstream of the mill is derived in the case of a departure of the fuel stream temperature from the proper range, minimizes the necessity of overriding the automatic control of the fuel feed when high load rate changes occur.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A process for exercising control over the operation of a mill which produces a fuel/air mixture for injection into a fuel consuming load, the mill receiving a solid fuel to be pulverized and a pressurized carrier gas which is to entrain the pulverized fuel to produce the fuel stream, the improvement comprising:

measuring the temperature of the carrier gas delivered to the mill and producing signals commensurate therewith;

measuring the temperature of the fuel stream exiting the mill and producing signals commensurate therewith;

storing values of desired carrier gas temperature upstream of the mill as a function of the quantity of solid fuel delivered to the mill, the stored values being commensurate with fuel stream temperature within a predetermined range;

controlling the rate of flow of carrier gas to the mill as a function of the sensed temperature of the carrier gas upstream of the mill;

comparing the actual temperature of the carrier gas upstream of the mill with a stored value of desired carrier gas temperature;

varying the carrier gas temperature to cause the actual and desired temperatures to be equalized; and adjusting the stored value of desired temperature as a function of a mill load when the fuel stream temperature falls outside of the predetermined range.

2. The process of claim 1 wherein the carrier gas is a mixture of heated and unheated gas derived from separate sources and the step of varying carrier gas temperature comprises:

exercising control over the volume of unheated gas to thereby vary the ratio of heated to unheated gas comprising the carrier gas mixture.

3. The process of claim 2 wherein the step of controlling the rate of flow of the carrier gas comprises:

controlling the volume of heated gas in accordance with a predetermined schedule of carrier gas volume versus carrier gas temperature.

4. The process of claim 1 wherein the step of comparing actual and desired carrier gas temperatures includes:

providing a signal commensurate with the rate of delivery of solid fuel to the mill;

looking up the desired carrier gas temperature from the stored values as a function of the signal commensurate with fuel delivery; and comparing the looked-up temperature with the measured carrier gas temperature to determine if there is a deviation which requires correction.

5. The process of claim 1 wherein the step of adjusting the stored value of desired carrier gas temperature includes:

comprising the measured fuel stream temperature with reference levels commensurate with maximum and minimum fuel stream temperatures; and storing a new desired carrier gas temperature level in place of a previously stored level if the measured fuel stream temperature is outside of the range defined by the maximum and minimum temperatures.

6. The process of claim 5 wherein the step of comparing actual and desired carrier gas temperatures includes:

providing a signal commensurate with the rate of delivery of solid fuel to the mill;

looking up the desired carrier gas temperature from the stored values as a function of the signal commensurate with fuel delivery.

7. The process of claim 5 wherein the carrier gas is a mixture of heated and unheated gas derived from separate sources and the step of varying carrier gas temperature comprises:

exercising control over the volume of unheated gas to thereby vary the ratio of heated to unheated gas comprising the carrier gas mixture.

8. The process of claim 7 wherein the step of controlling the rate of flow of the carrier gas comprises:

controlling the volume of heated gas in accordance with a predetermined schedule of carrier gas volume versus carrier gas temperature.

9. The process of claim 8 wherein the step of comparing actual and desired carrier gas temperatures includes:

providing a signal commensurate with the rate of delivery of solid fuel to the mill;

looking up the desired carrier gas temperature from the stored values as a function of the signal commensurate with fuel delivery; and comparing the looked-up temperature with the measured carrier gas temperature to determine if there is a deviation which requires correction.

* * * * *